US005387048A

United States Patent [19]

Kuo

[11] Patent Number: 5,387,048

[45] Date of Patent: Feb. 7, 1995

[54] SECURING MEANS FOR TELESCOPIC STICKS OF A MULTIPLE-FOLD UMBRELLA

[76] Inventor: Cheng M. L. Kuo, 18, Alley 15, Lane 582, Sea Ta Road, Hsinchu, Taiwan, Prov. of China

[21] Appl. No.: 101,010

[22] Filed: Aug. 3, 1993

[51] Int. Cl.[6] ..... A45B 19/04

[52] U.S. Cl. ..... 403/109; 403/328; 403/329; 135/25.1; 135/75; 15/144.4

[58] Field of Search ..... 135/25.1, 75, 108; 403/328, 329, 109; 15/144.4

[56] References Cited

U.S. PATENT DOCUMENTS

| | | | |
|---|---|---|---|
| 2,932,047 | 4/1960 | Johnston | 15/144.4 |
| 2,984,852 | 5/1961 | George | 15/144.4 |
| 4,247,216 | 1/1981 | Pansini | 15/144.4 |
| 4,793,646 | 12/1988 | Michaud, Jr. | 15/144.4 |
| 5,228,202 | 7/1993 | Liao | 15/144.4 |
| 5,287,869 | 2/1994 | Wu | 135/25.1 X |

FOREIGN PATENT DOCUMENTS

| | | | |
|---|---|---|---|
| 1185765 | 8/1959 | France | 135/25.1 |

*Primary Examiner*—Edward K. Look
*Assistant Examiner*—Michael S. Lee
*Attorney, Agent, or Firm*—Morton J. Rosenberg; David I. Klein

[57] ABSTRACT

The invention relates to a securing means for the telescopic stick of a multiple-fold umbrella, mainly comprising a U-shaped resilient element having round holes disposed thereon mounting on a stub with the two end portions extending into the grooves situated on the sides of the stub. On the stub is transversely arranged a hole that provides rooms for a spring and a locating plunger. The stub, integrated with the spring and the plunger, is placed into an inner tube where the stub, in conjunction with detent balls and positioning holes on the peripheral walls of the inner and the outer tubes, can provide stable, reliable latching and positioning functions for telescopic tubes as the umbrella is opened.

1 Claim, 3 Drawing Sheets

SECURING MEANS FOR TELESCOPIC STICKS OF A MULTIPLE-FOLD UMBRELLA

BACKGROUND OF THE INVENTION

A conventional telescopic stick for a multiple-fold umbrella is generally made up of two to four telescopic tubes guided in one another, which enables the umbrella to be folded into a compact form for convenient handling and storage. Such a telescopic stick, when opening the umbrella, is extended to a certain length by extracting tubes in sequence. To prevent tubes from falling off, a securing means is needed to keep tubes of an extended stick connected and provide positioning functions. Numerous varied means have been proposed and developed in the past years; however, their common shortcoming was unable to preserve stability of operation. This has resulted in the telescoping tubes moving laterally with respect to each other which often happens while using a conventional umbrella. Although many improvements have been attempted, they failed due to either complex structures or difficulty-to-assemble and have had no significant effect in firmly securing one tube to another. Up to now there is no securing means that have a simple structure and can provide increased stability of the connected tubular members.

In view of that, the primary object of the invention is to provide a useful securing means for telescopic sticks, which can provide the foregoing functions without the problems occurred in prior art telescopic sticks.

The structure, features, and advantages of the invention can be best understood from the following detailed description, taken in conjunction with the accompanying drawings.

Figure 1:
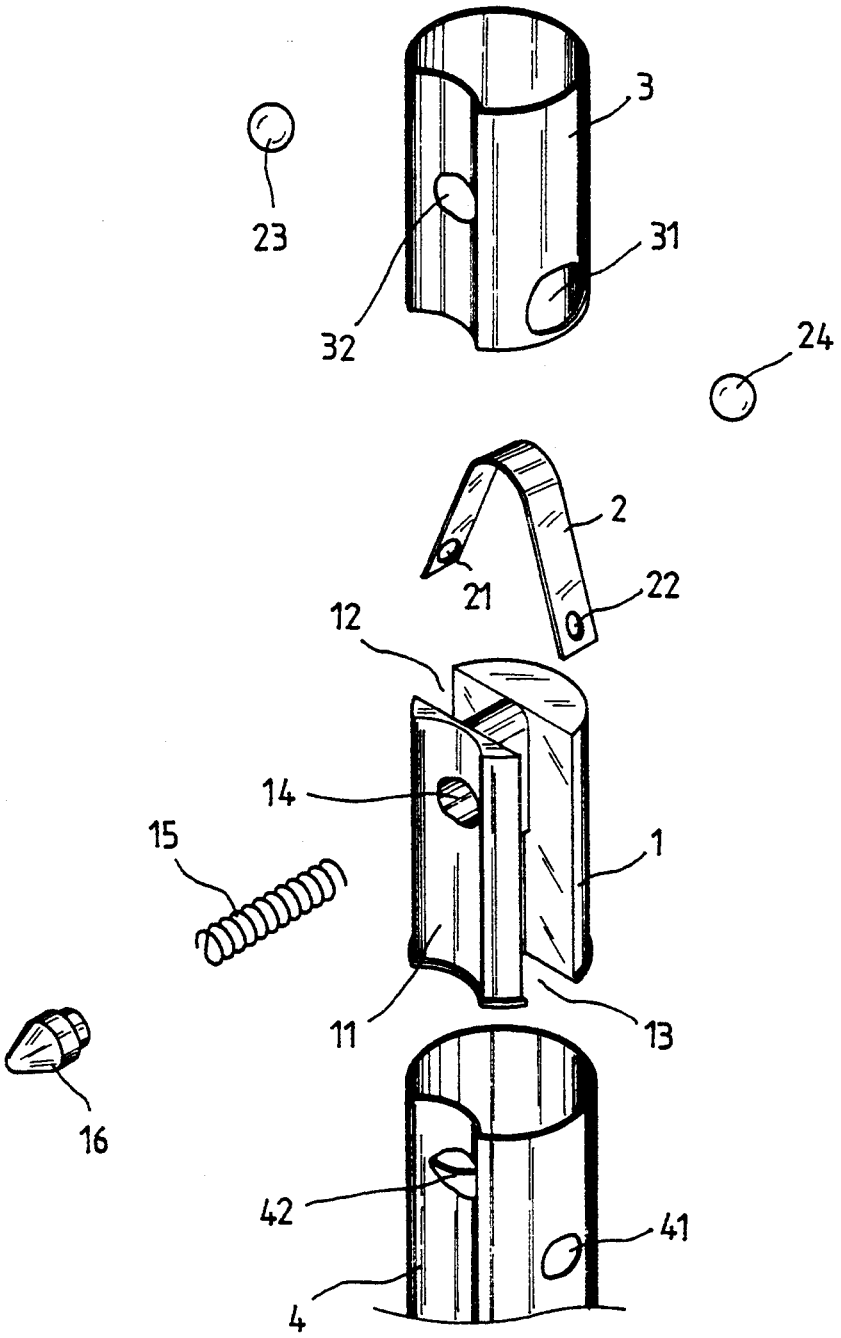
FIG. 1 is an exploded perspective view showing an embodiment of the securing means of the invention.

Referring to the drawings, the stub (1) of the securing mechanism is designed to have formed on a portion of its cylindrical surface a recessed curved surface mating with corresponding inner wall surfaces of telescopic tubes for the purpose of positioning, two grooves (12), (13) disposed on two opposing sides thereof, and a transverse hole to receive a spring (15) and a plunger (16). A U-shaped resilient element (2) having holes (21), (22) situated on two ends thereof mounts on the stub (1), with the two end portions extending into the grooves (12), (13). The stub, associated with the resilient element (2) and two steel balls (23), (24), is placed into an inner tube (3), with these two steel balls being in linear alignment with two round holes (21), (22) as well as two positioning holes (31) formed on the inner tube (3). The spring force of the U-shaped resilient element (2) makes two steel balls (23), (24) press against the rims of holes (31) but not go through the holes because the hole diameter is smaller than that of balls. In addition, the plunger (16) presses against the hole (32) in a similar way.

Figure 2:
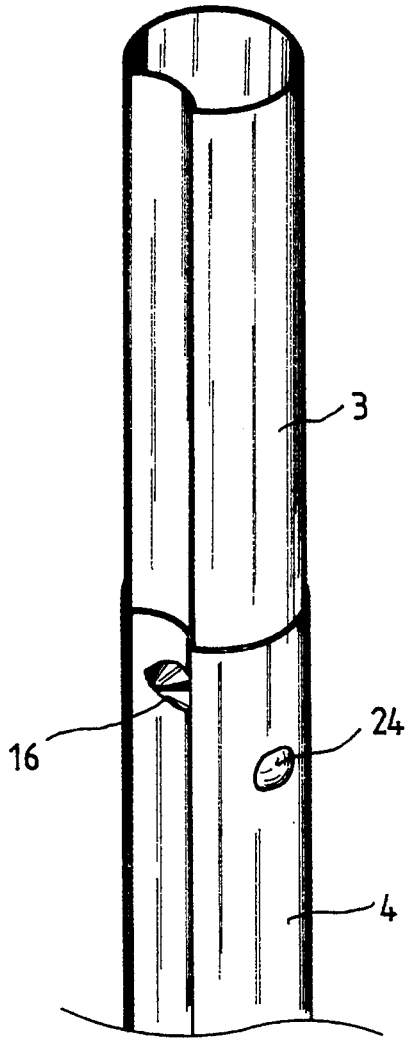
FIG. 2 is a perspective view showing the securing means of FIG. 1, in an assembled state.
Figure 3:
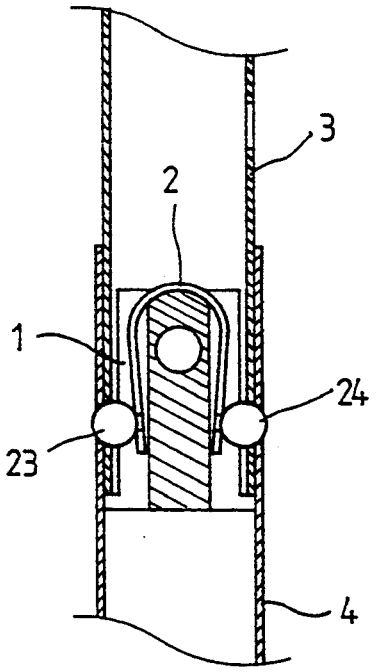
FIG. 3 is a cross section view of the securing means shown in FIG. 2.

The outermost apexes of two steel balls (23), (24) will extrude into two opposing holes (41) formed on the wall of the outer tube (4) when extracting an inner tube (3) from an outer tube (4) to extend an umbrella stick as shown in FIGS. 2 and 3. At this time, the plunger (16) biased outwards by the spring (15) enters another positioning hole (42) provided on one side of the outer tube (4), forming another locating point. With the tubes 3 and 4 held in three different directions, the inner tube can be kept from sliding out of the outer tube and assured to have a firm securing.

In summary, the invention chiefly provides a concise means having a compact, easy-to-assemble structure which holds telescoping tubes in a stable manner.

What is claimed is:

1. A tubular telescopic umbrella securement system comprising:

(a) an outer tubular member having an outer tubular positioning hole and a pair of opposing outer tube openings formed through an outer tubular member sidewall;

(b) an inner tubular member telescopically received within said outer tubular member, said inner tubular member having an inner tubular positioning hole and a pair of opposing inner tube openings formed through a sidewall thereof for respective alignment with said outer tube positioning hole and said pair of opposing outer tube openings;

(c) a stub member insertable within said inner tubular member having a stub member recess formed in a sidewall thereof for alignment with said outer and inner tube openings, said stub member having vertically extending grooves formed within opposing sidewalls thereof;

(d) a spring biased locating plunger displaceable through said outer and inner tubular positioning holes and within said stub member recess; and, (e) a U-shaped resilient member having a pair of detent ball members secured to end sections of a pair of leg members, said U-shaped resilient member being mounted within said stub groove over an upper surface of said stub member for alignment of said detent ball members with said inner and outer tube openings.

* * * * *